US012195248B2

(12) United States Patent
Anderson

(10) Patent No.: US 12,195,248 B2
(45) Date of Patent: Jan. 14, 2025

(54) WINE BOTTLE CORK HOLDER

(71) Applicant: James Anderson, Coalinga, CA (US)

(72) Inventor: James Anderson, Coalinga, CA (US)

( * ) Notice: Subject to any disclaimer, the term of this patent is extended or adjusted under 35 U.S.C. 154(b) by 32 days.

(21) Appl. No.: 18/097,126

(22) Filed: Jan. 13, 2023

(65) Prior Publication Data

US 2024/0239570 A1 Jul. 18, 2024

(51) Int. Cl.
*B65D 51/16* (2006.01)
*B65D 39/00* (2006.01)
*B65D 55/16* (2006.01)

(52) U.S. Cl.
CPC ..... *B65D 51/1611* (2013.01); *B65D 39/0076* (2013.01); *B65D 55/16* (2013.01); *B65D 2539/003* (2013.01)

(58) Field of Classification Search
CPC ..... B01F 2101/17; A47G 23/0241; A47G 2400/045; B65D 47/06; B65D 39/00; B65D 39/0058
See application file for complete search history.

(56) References Cited

U.S. PATENT DOCUMENTS 4,363,416 A * 12/1982 Loughmiller ..... B65D 39/0064 215/364
7,543,978 B2 6/2009 Clement
D664,848 S * 8/2012 DuBow ..... D7/628
8,485,503 B2 7/2013 Lei
2005/0127266 A1 6/2005 Arney
2005/0184026 A1 8/2005 Haley
2006/0151426 A1 7/2006 Peters
2008/0219092 A1* 9/2008 Clement ..... B01F 33/5011 366/129
2012/0201942 A1* 8/2012 Kilduff ..... B01F 33/5012 261/6
2013/0153609 A1* 6/2013 Carroll ..... B65D 81/366 222/479

FOREIGN PATENT DOCUMENTS

JP 10257567 A 2/1990

OTHER PUBLICATIONS

English abstract for foreign patent document JPH0257567A.

* cited by examiner

*Primary Examiner* — Shawn M Braden
(74) *Attorney, Agent, or Firm* — Sierra IP Law, PC; William K. Nelson

(57) ABSTRACT

A wine cork display and aerating system is disclosed. The wine cork system includes a plug with a corresponding sleeve operable to form a fluid tight seal inside the neck of a bottle, a holder operable to secure a wine cork and a plurality of aeration holes in communication with the bottle's contents to allow the wine to breathe and to prevent contamination of the wine.

17 Claims, 12 Drawing Sheets

WINE BOTTLE CORK HOLDER

FIELD OF THE INVENTION

The present invention relates to a wine bottle stopper that is operable to aerate wine when engaged with a bottle and to retain the cork. More particularly, the invention relates to a cork-holding device that may aerate a beverage and provide a watertight seal while being operable to hold a cork and prevent the wine in a bottle from being contaminated.

BACKGROUND OF THE INVENTION

Wine bottles are opened and allowed to breathe to enhance the flavor, by reincorporating oxygen into the wine and changing the flavor profile to highlight specific flavors and tannins. Wine aerators are used to allow the wine in the bottle to breathe by removing the cork, this often results in the loss of the cork, and a replacement cork is used for storage of the bottle. While aeration is an important process in the wine-drinking experience, the wine can be contaminated while being allowed to breath. Ambient dust or other airborne particles may fall in the bottle, and fruit flies or other pests may enter the bottle as they are attracted to the fermented smell of the wine.

Additionally, conventional bottle stoppers fail to provide a safekeeping position for the cork when not in use. Prior iterations of bottle stoppers also fail to achieve fluid-tight seals and aerating holes that are small enough to prevent flies, while also providing a display for the cork. There is a need for an aerating system that allows a bottle to breathe while not losing the original cork of the bottle for future storage.

SUMMARY OF THE INVENTION

The present invention provides a wine cork having a holder and aerating device and methods of using such a device. The wine cork of the present invention is operable to provide a fluid-tight seal inside the neck of a wine bottle and includes a holder operable to receive a wine cork and has openings that allow the wine to breathe and aerates the wine as while being poured into a glass. The openings are configured to prevent flies or other pests from contaminating the wine or falling into the wine bottle. The device may include a holder operable and sized to hold a wine bottle cork. The device may include a sealing plug having barbs, ribbing, or other protrusions and is operable to fit inside the neck of a wine bottle while being secured by the friction of the protrusions of the plug. The invention uses barbs, ribbing (e.g., like O-rings), or other protrusions on the sealing plug that ensure a fluid-tight seal and utilize aeration holes of small form factors, thus preventing contamination of the contents of the bottle.

In some embodiments, the device may include a sealing sleeve that includes barbs, ribbing, or other protrusions positioned over the plug. In such embodiments, the plug may have a cylindrical construction having a diameter that is less than the inner diameter of the neck of a wine bottle to allow the sealing sleeve over the plug. The sealing sleeve may be pressure fit, adhered, or otherwise secured to the plug, the diameter of the sealing sleeve when positioned on the plug has an outer diameter that may be equal to or slightly larger than the inner diameter of the neck of a wine bottle to allow compression of the protrusions of the sealing sleeve to seal a wine bottle. The sealing sleeve may be fabricated from flexible and resilient polymeric material, such as silicone, polyvinyl chloride, polyethylene (e.g., low-density, medium density), or other appropriate materials. The plug may be a more rigid material such as a high-density PVC or other polymer, polished brass, polished steel, aluminum, wood, or other appropriate materials. In some embodiments, the plug may be formed integrally with the cork holder.

In some embodiments, there may be channels in the plug operable to receive a plurality of individual O-rings for providing a fluid-tight seal with the wine bottle neck. The O-rings may be slid onto the cork holder and positioned equidistantly apart. The O-rings may have a height in a range of between eight to fifteen millimeters and a diameter in a range of about ten to fifteen millimeters. In other embodiments, the diameter of the plug may be configured to fit a variety of bottle sizes. The O-rings may be fabricated from a polymeric material, such as nitrile (Buna), polychloroprene, ethylene propylene (EPDM Rubber), Silicone, Fluorocarbon (Viton), or tetrafluoroethylene (PTFE).

In other embodiments, the barbs, ribbing, or other protrusions of the sealing plug may be integrally formed in the plug, and may be formed monolithically of the same material. In such embodiments, the plug may be fabricated from a flexible and resilient polymeric material, such as silicone, polyvinyl chloride, polyethylene (e.g., low-density, medium density), or other appropriate materials.

In some embodiments, a plurality of aeration holes may be axially positioned around the axis of the cork holder and used to aerate the fluid inside the bottle. In some embodiments, the aeration holes may be small enough to prevent small insects (e.g., fruit flies) from entering the bottle and contaminating the fluid within. The aeration holes may be in fluid communication with a central passage in the plug that allows for air to pass through the aeration holes and into the bottle through the plug. Aeration of the fluid is necessary to introduce air which triggers the stages of oxidation and evaporation. Once the fluid is aerated, the full aroma and flavor of the fluid are present and available to enhance the experience of the wine.

In some embodiments, there may be at least two aeration holes visible from the front and back of the cork holder. The shape of the aeration holes may have various shapes, such as polygonal (e.g., rectangular, triangular, pentagonal, etc.), elliptical, circular, or other appropriate shape. In other embodiments, the aeration holes may have a slotted or conical geometry to allow aeration of the fluid inside the bottle. In the same embodiment, the aeration holes of varying geometries may be small enough to prevent insects from entering and contaminating the fluid.

In some embodiments, the cork holder of the present invention is operable to secure a cork of a conventional wine bottle. The cork holder may be made from a flexible material, such as a flexible and resilient polymeric material, such as silicone, polyvinyl chloride, polyethylene (e.g., low-density, medium density), or other appropriate materials. In some embodiments, the cork holder may be constructed from a rigid material, such as polished brass, polished steel, aluminum, wood, or other appropriate materials.

There may be a plurality of arms (e.g., 2, 3, 4, or more arms) on the cork holder that extend upward from a seat of the holder and are operable to secure the cork. The arms have a curved shape that is complementary to the outer circumference of a wine bottle cork. The arms have a convex lower portion to accommodate and hold the cork in the seat and a concave portion near the distal end of the arm. In some embodiments, the cork holder may be flexible, which aids in press-fitting a cork into the cork holder and also allows the cork holder to accept corks of a variety of different diameters and lengths. The cork holder may be able to accept and secure corks which have a diameter in a range of about ½ in. to about 1 in. For example, the cork holder may be able to accommodate cork sizes #7 (¾ in. diameter), #8 (⅞ in. diameter), #9 (15/16 in. diameter), and #10 (1 in. diameter).

The present invention provides a device and method for securing a cork on the bottle stopper device that allows it be displayed when the stopper device is inserted in a bottle or when the stopper is placed on a surface to display the cork while wine is being poured. The device includes a holder and sealing sleeve that is operable to fit inside a wine bottle while being secured by the friction of the barbs, ribbing, or other protrusions on the sealing sleeves.

It is an object of the present invention to provide a cork holder that is operable to secure and present a cork after a wine bottle or other beverage container has been opened.

It is an object of the present invention to provide a cork holder that is operable to be inserted into the neck of a wine bottle or other beverage container securely while also securing and presenting the cork removed from the wine bottle or other container.

It is an object of the present invention to provide a cork holder which includes narrow aeration openings which are operable to provide an aeration mechanism that prevent contamination (e.g., dust, insects, etc.) of the wine or beverage inside a bottle or other container in which the cork holder has been inserted. The size of the aeration holes may be in a range of about 0.6 millimeters to about 1.2 millimeters.

In one aspect, the present invention relates to a wine aerating device operable to secure to a wine cork, including a bottle stopper having a plug and at least one hole operable to allow the contents of the bottle to breathe; a seat for receiving a cork; extensions extending above the seat that may be operable to secure the cork to the seat; and one or more protrusions positioned on a side of the plug that may be operable to provide a fluid-tight seal with the neck of a bottle, wherein the bottle stopper may be temporarily positioned in the neck of a bottle and said extensions are operable to secure the cork for display and to allow the contents of the bottle to breathe through the at least one hole. The at least one hole may be a plurality of holes axially positioned around the center line of the bottle stopper. The at least one protrusion may be a barb, rib, or O-ring. The device may further include a sleeve positioned on the plug that may be operable to provide a fluid-tight seal. The extensions may include may form a complementary slot or space that may have a complementary shape to the geometry of a standard wine cork and a diameter that is same or similar to the cork (e.g., the slot or space may have a slightly smaller diameter than the cork. The extensions may include four extensions and may be symmetrically positioned at the corners of the base and have a curved geometry operable to secure the wine cork. The plurality of holes may be at least two holes having a slotted geometry and are in fluid communication with a conduit passing through the plug that is operable to expose the contents of the bottle to the atmosphere. The conduit may be positioned to aerate the contents of the bottle and provide an inlet and outlet along the centerline of the cork holder. The at least two holes have a geometry operable to prevent insects and debris from entering the contents of the bottle. The cork holder base has a substantially rectangular geometry with a seat having an area that is substantially equal to an axial cross-section of a standard wine bottle cork.

In another aspect, the present invention relates to a wine aerating device operable to secure to a wine cork, the device comprising: a bottle stopper having a plug and at least two aeration holes operable to allow the passage of ambient air into the bottle; and a cork holder extending above the bottle stopper having a base and a plurality of arms that are operable to secure a cork in a seat of the cork holder; and at least one protrusion located at a side of the plug that may be operable to provide a fluid-tight seal between the neck of a bottle and the bottle stopper. The plurality of arms may be operable to secure the cork and present it for display when the device is engaged with the neck of the bottle.

In another aspect, the present invention relates to a method for aerating wine and securing a wine cork, the method comprising: inserting a wine bottle stopper into a neck of a wine bottle, the wine bottle stopper having 1) a plug for engagement with the neck of a wine bottle and at least one protrusion located at a side of a plug, 2) a conduit passing through the plug that is in communication with at least one aeration port, and 3) a plurality of extensions that form a slot having a shape that is complementary to a cork; for securing a wine cork in said slot. The at least one port may include at least two ports that are operable to allow ambient air to pass into the wine bottle and are sized to prevent contamination of the contents of the bottle. The aeration ports may be positioned orthogonal to a centerline of the wine bottle. The plug may be operable to form a fluid-tight seal between the plug and the neck of the bottle.

Further aspects and embodiments will be apparent to those having skill in the art from the description and disclosure provided herein.

The above-described objects, advantages, and features of the invention, together with the organization and manner of operation thereof, will become apparent from the following detailed description when taken in conjunction with the accompanying drawings, wherein like elements have like numerals throughout the several drawings described herein. Further benefits and other advantages of the present invention will become readily apparent from the detailed description of the preferred embodiments.

DETAILED DESCRIPTION

Figure 1:
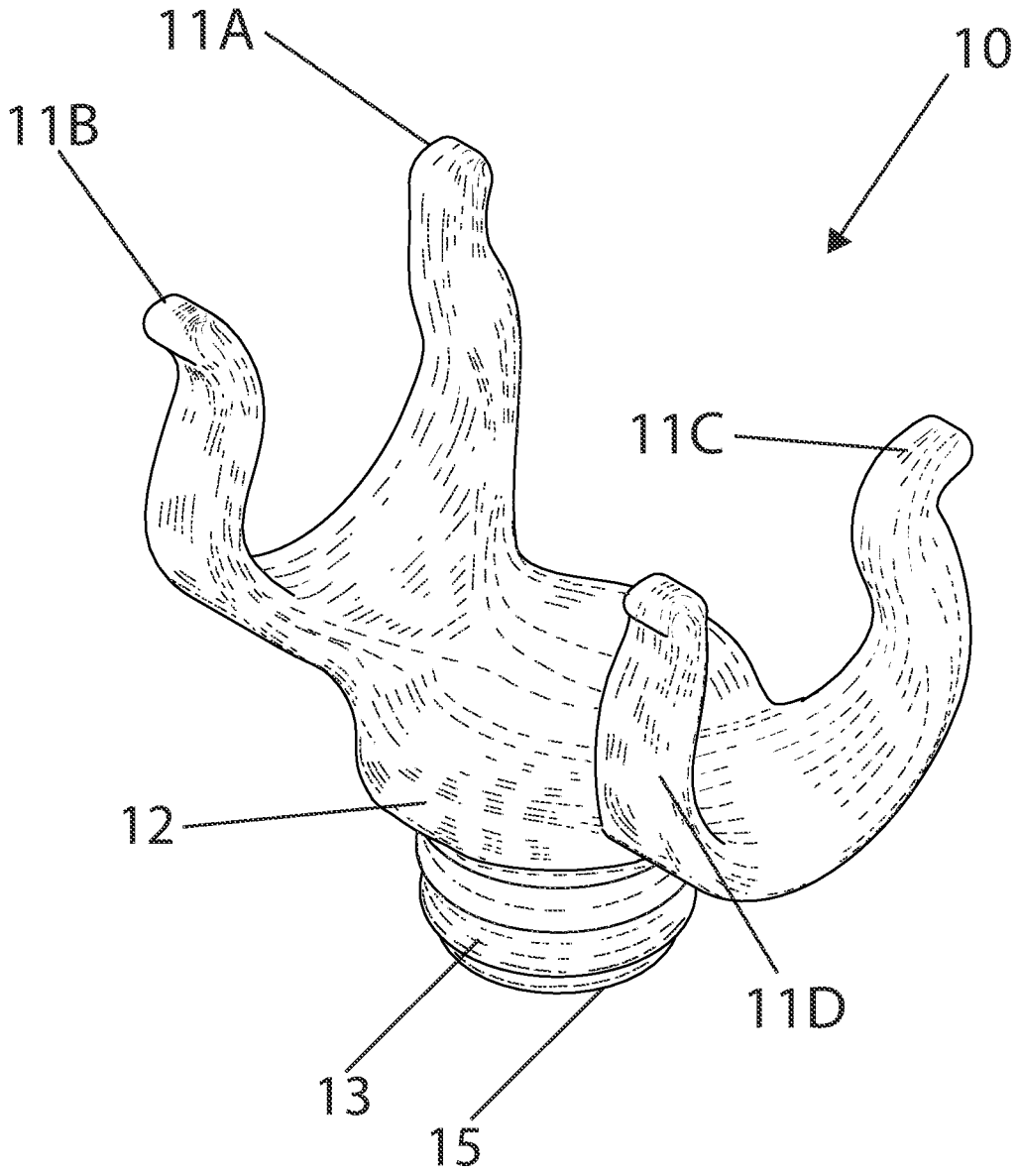
FIG. 1 provides a perspective view of a cork holder, according to an embodiment of the present invention.
Figure 2:
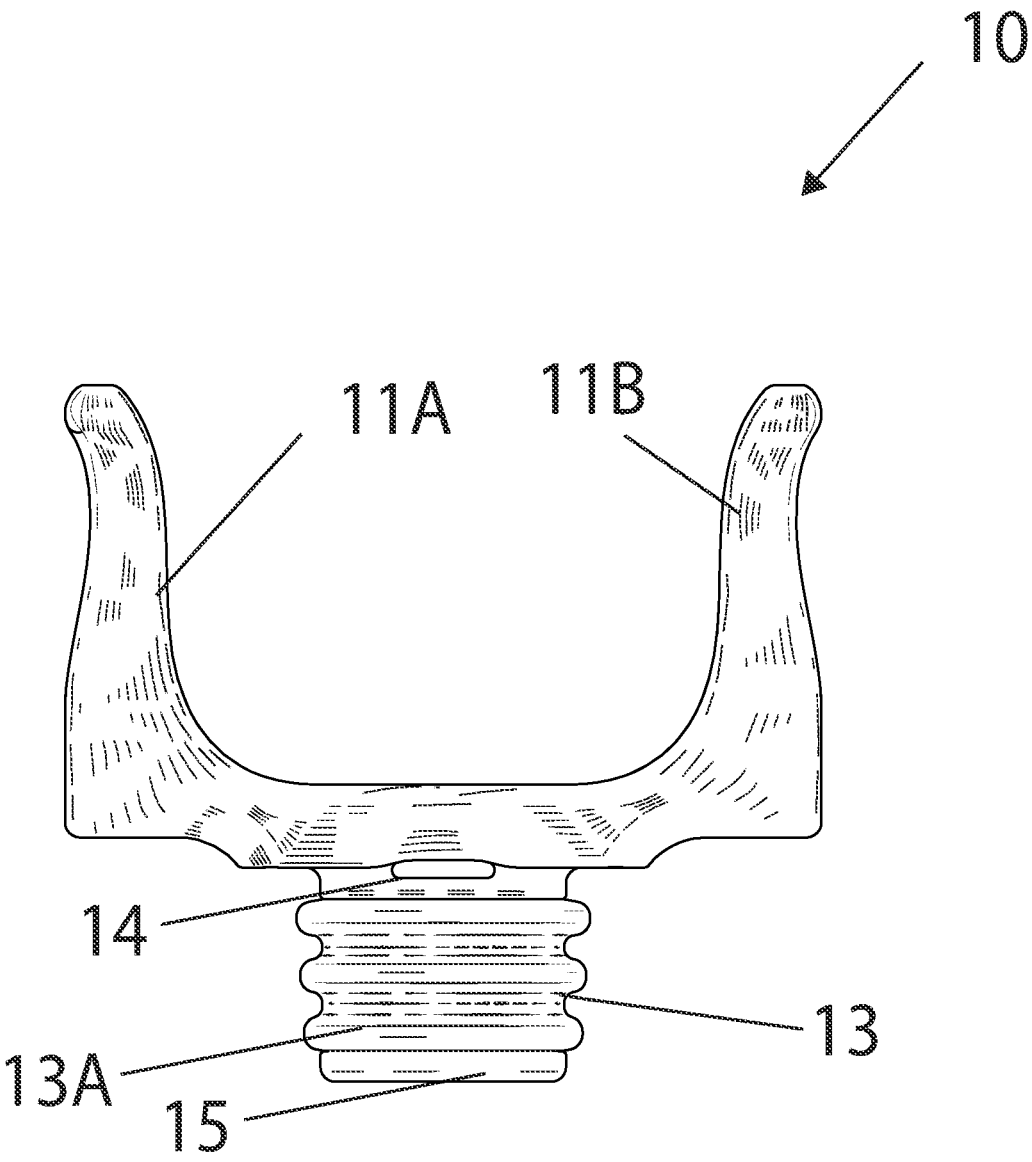
FIG. 2 provides a front view of a cork holder, according to an embodiment of the present invention.
Figure 3:
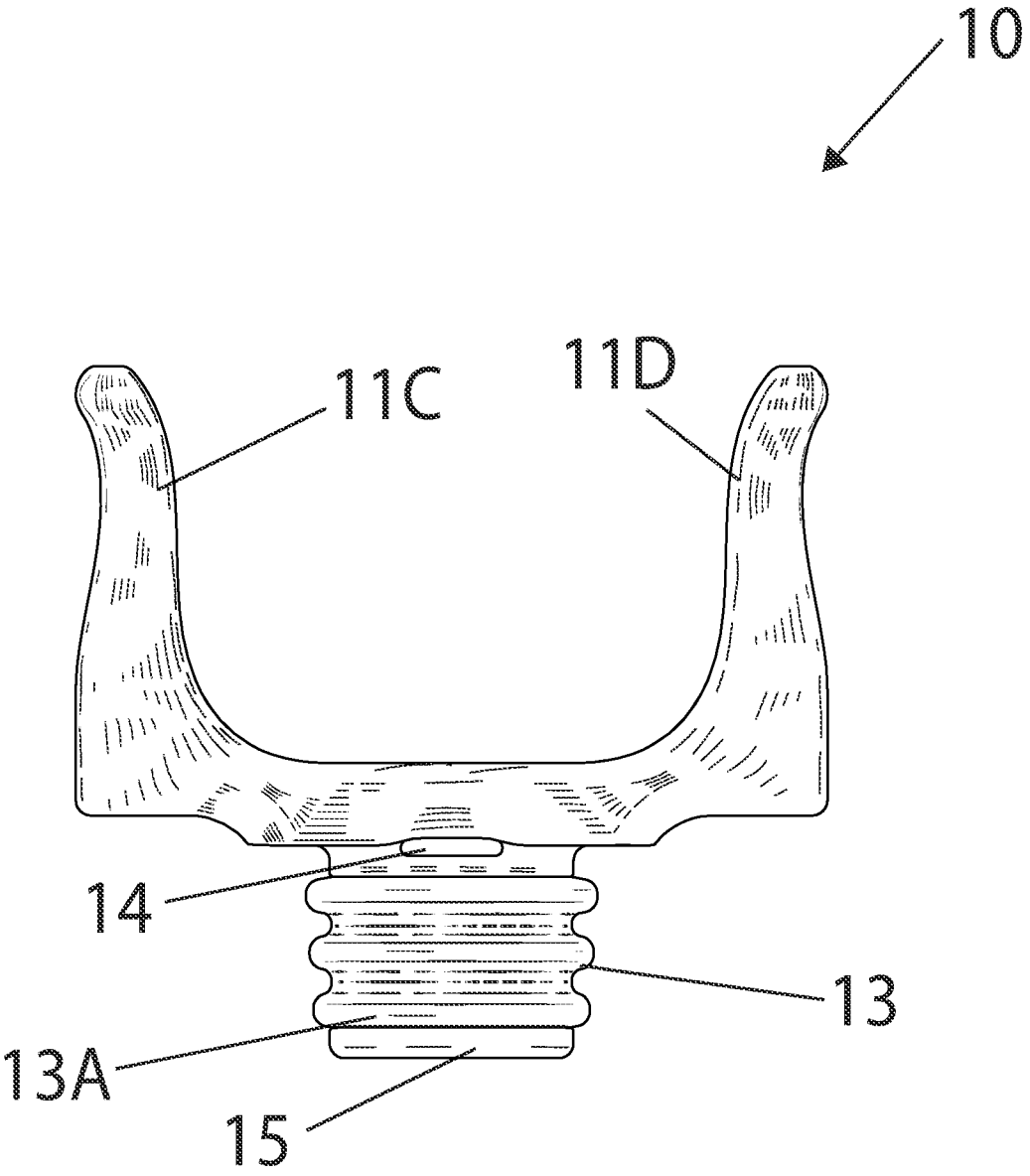
FIG. 3 provides a rear view of a cork holder, according to an embodiment of the present invention.

A detailed discussion of certain embodiments of the invention is provided below, examples of which are illustrated in the accompanying drawings. While the invention will be described in reference to these figures and certain implementations and examples of the embodiments, it will be understood that such implementations and examples are not intended to limit the invention. To the contrary, the invention is intended to cover alternatives, modifications, and equivalents that are included within the spirit and scope of the invention as defined by the claims. In the following disclosure, specific details are given to provide a thorough understanding of the invention. References to various features of the "present invention" throughout this document do not mean that all claimed embodiments or methods must include the referenced features. It will be apparent to one skilled in the art that the present invention may be practiced without these specific details or features.

Reference will be made to the exemplary illustrations in the accompanying drawings, and reference characters may be used to designate like or corresponding parts throughout the several views of the drawings. FIGS. 1-12 provide views of an exemplary embodiment of a novel cork holder having a holder and sealing sleeve design.

The present invention provides a cork holder as shown in FIGS. 1-12 that is operable to secure a cork for display and to prevent loss of the cork and to aerate the contents of a bottle. The cork holder 10 may include arms 11A-D operable to secure a cork, a base 12 may include aerating holes 14 to aerate the contents of the bottle, and a set of protrusions 13 that may provide a watertight seal between the cork holder 10 and the bottle 83.

In some embodiments, the cork holder 10, as shown in the perspective view of FIG. 1, may include arms 11A-D that extend from the base 12. In such embodiments, there may be four arms 11A-D to secure a cork 82 in the base (or seat) 12. In some embodiments, the arms 11 A-D may be made of a flexible material to allow for flexion (e.g., resilient outward deflection) when a cork is inserted between the arms 11A-11D. The flexibility allows the cork holder 10 to accept corks of varying diameters and shapes. In other embodiments, the arms 11A-D may be made from a rigid material such as polished brass, polished steel, aluminum, wood, or other decorative material. In further embodiments, the arms may have sections made of different materials. For example, the arms 11A-11D may include upper sections that are made from rigid material (e.g., polished brass, polished steel, aluminum, wood, or other decorative material), and lower sections made from a flexible material that allows the arms to be deflected outward to accept corks of various diameters while still providing a decorative appearance.

Figure 4:
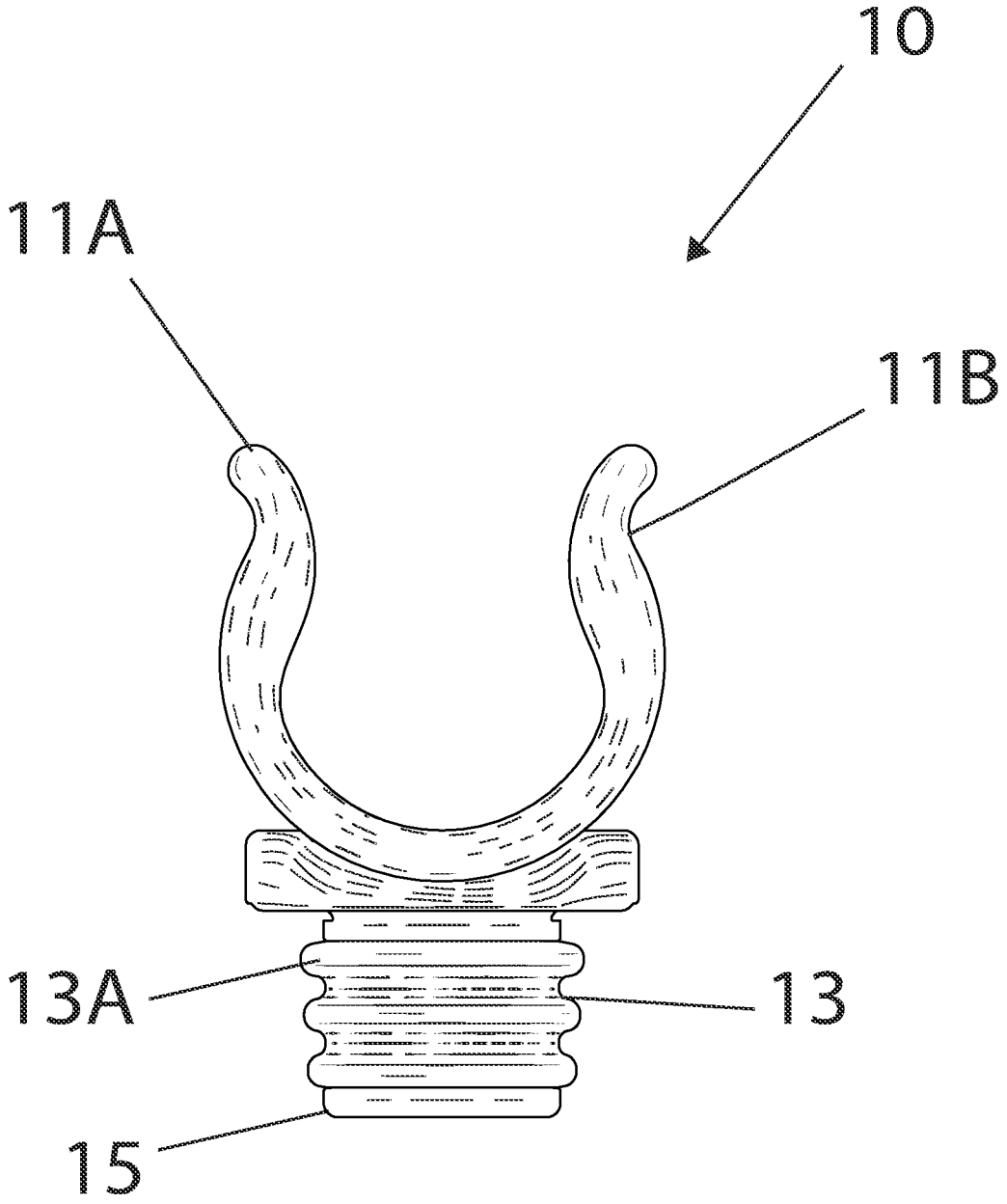
FIG. 4 provides a first side view of a cork holder, according to an embodiment of the present invention.
Figure 5:
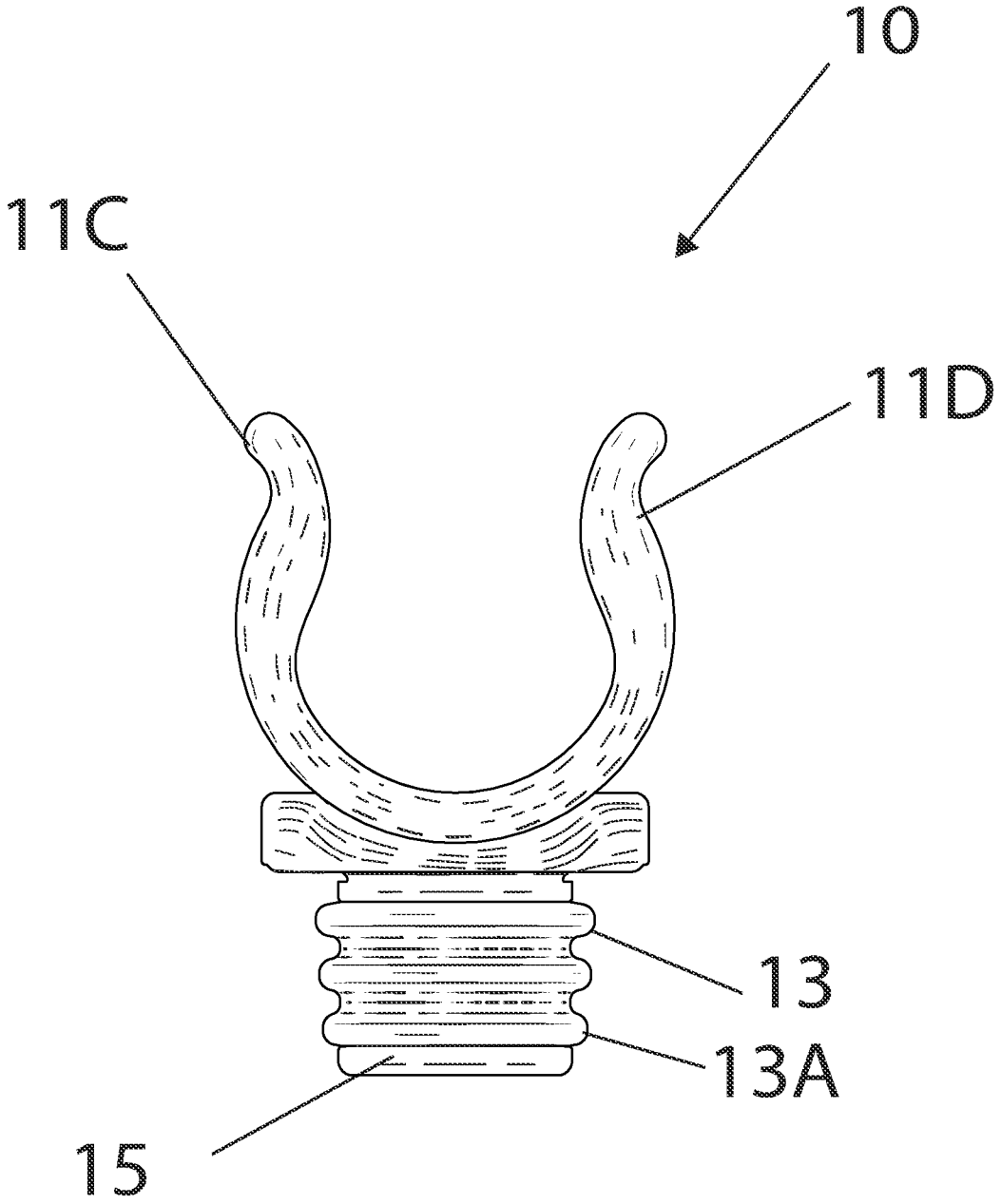
FIG. 5 provides a second side view of a cork holder, according to an embodiment of the present invention.
Figure 6:
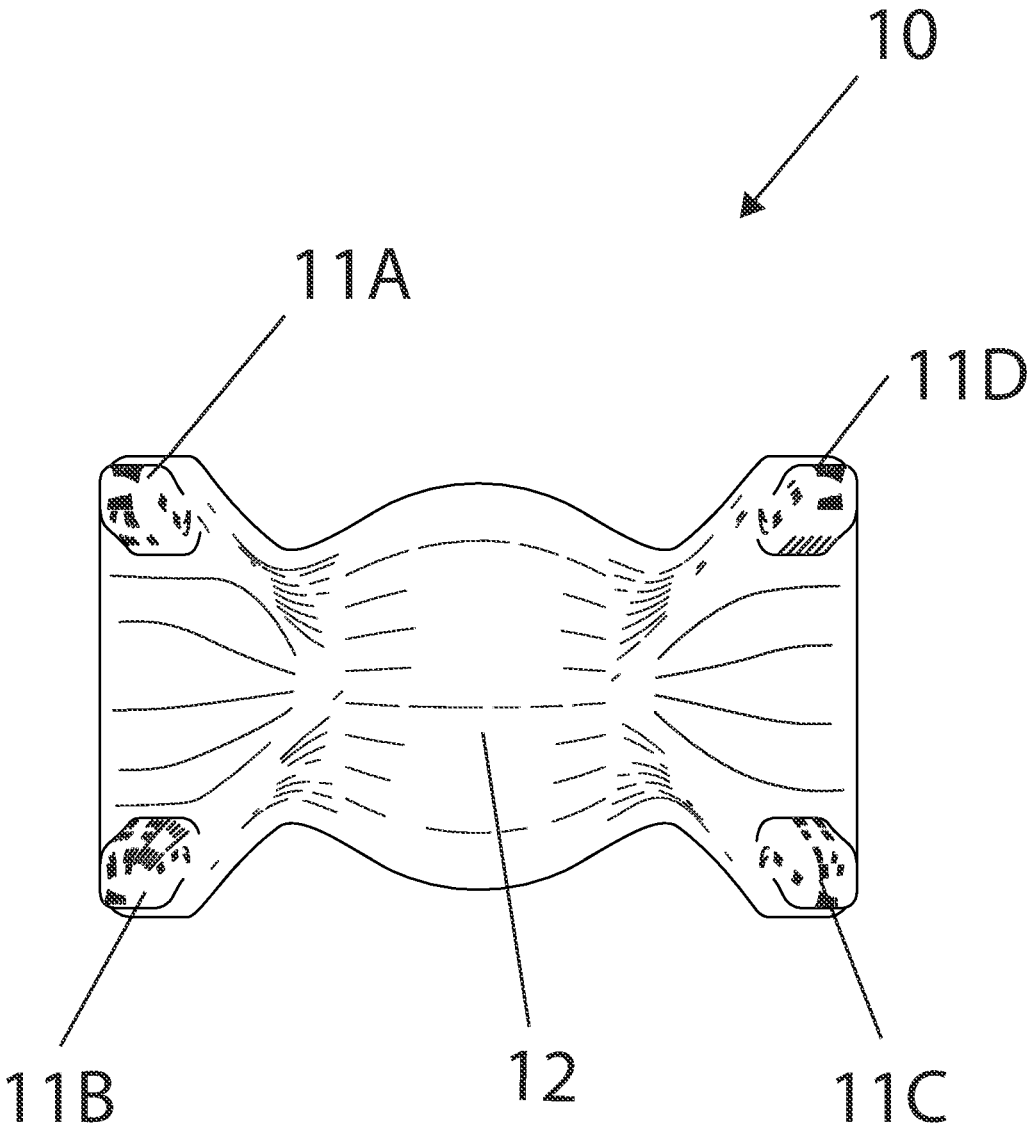
FIG. 6 provides a top view of a cork holder, according to an embodiment of the present invention.
Figure 7:
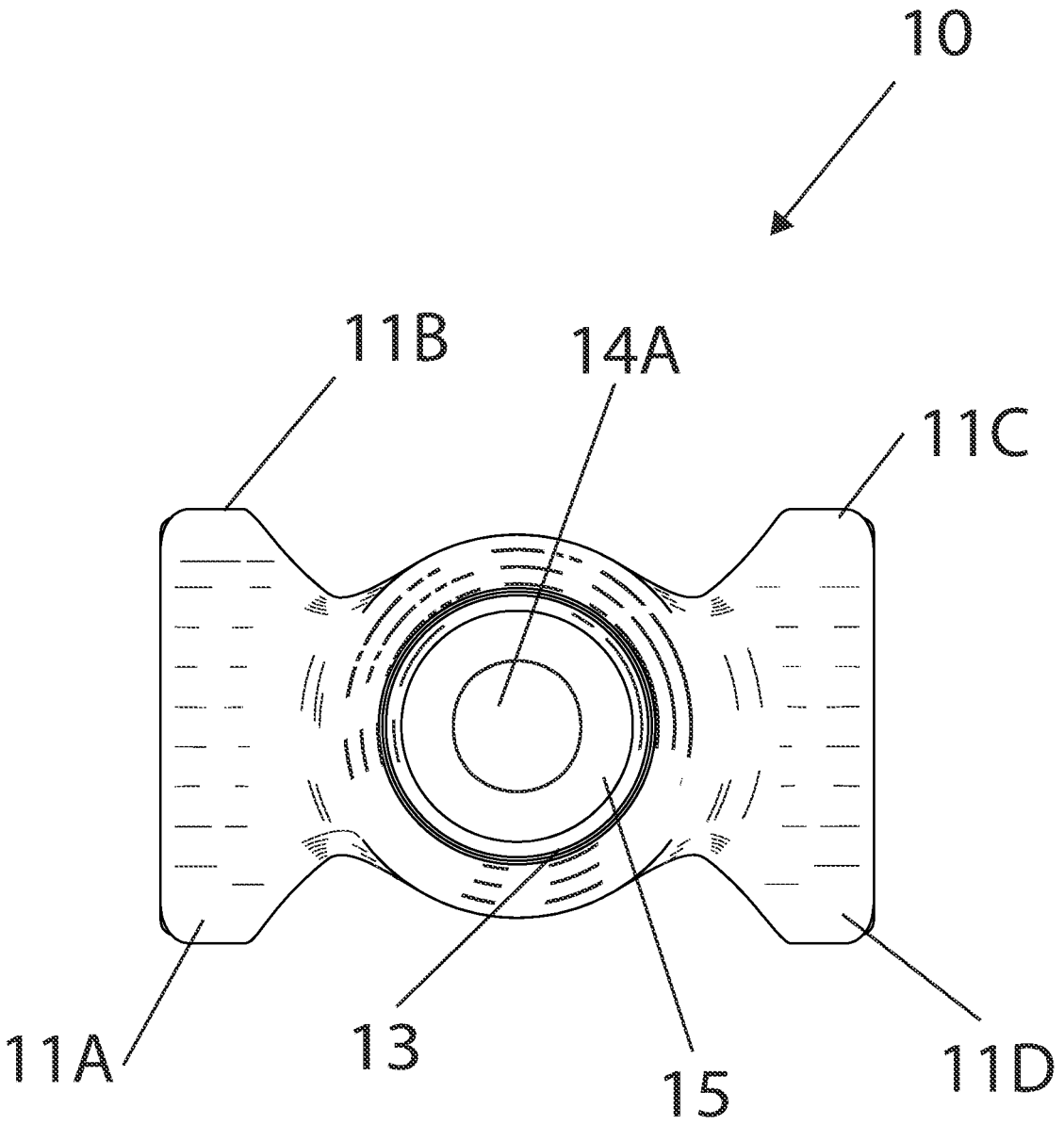
FIG. 7 provides a bottom view of a cork holder, according to an embodiment of the present invention.
Figure 8:
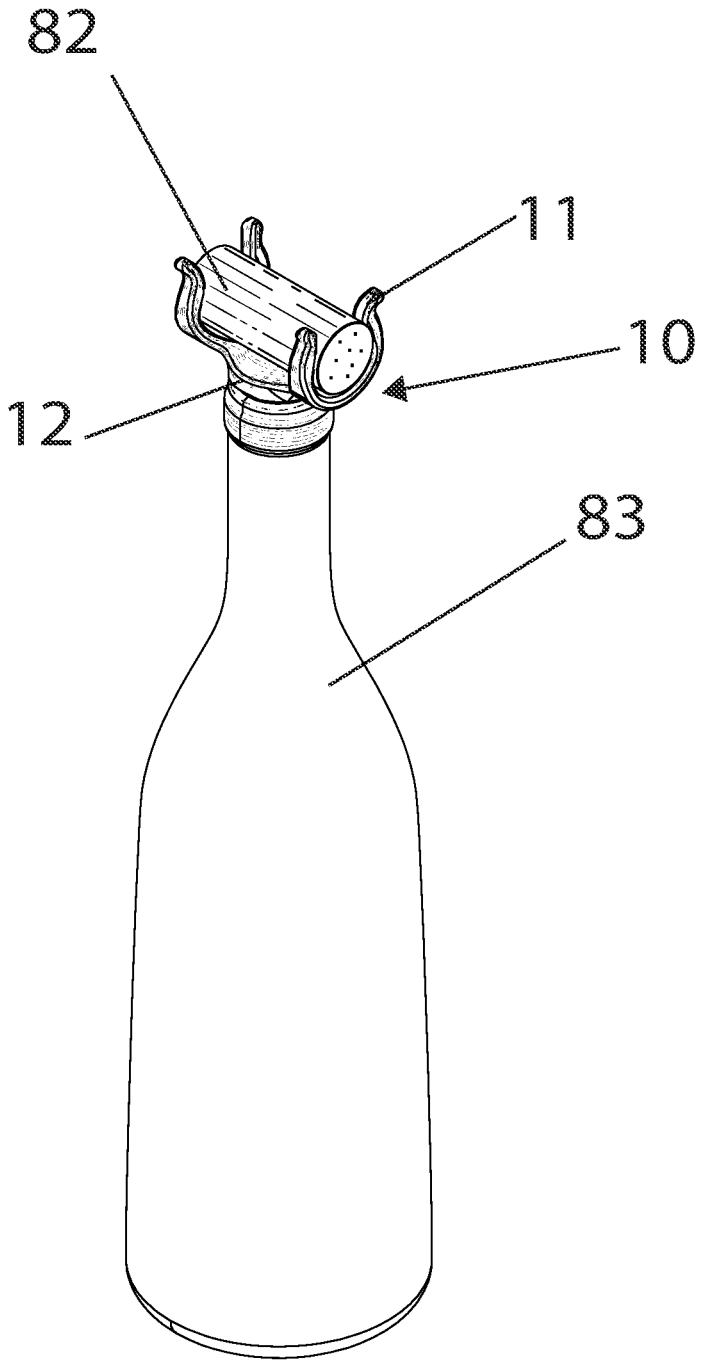
FIG. 8 provides a perspective environmental view of a cork holder system, according to an embodiment of the present invention FIG. 9 provides an exploded view of a cork holder system, according to an embodiment of the present invention.
Figure 9:
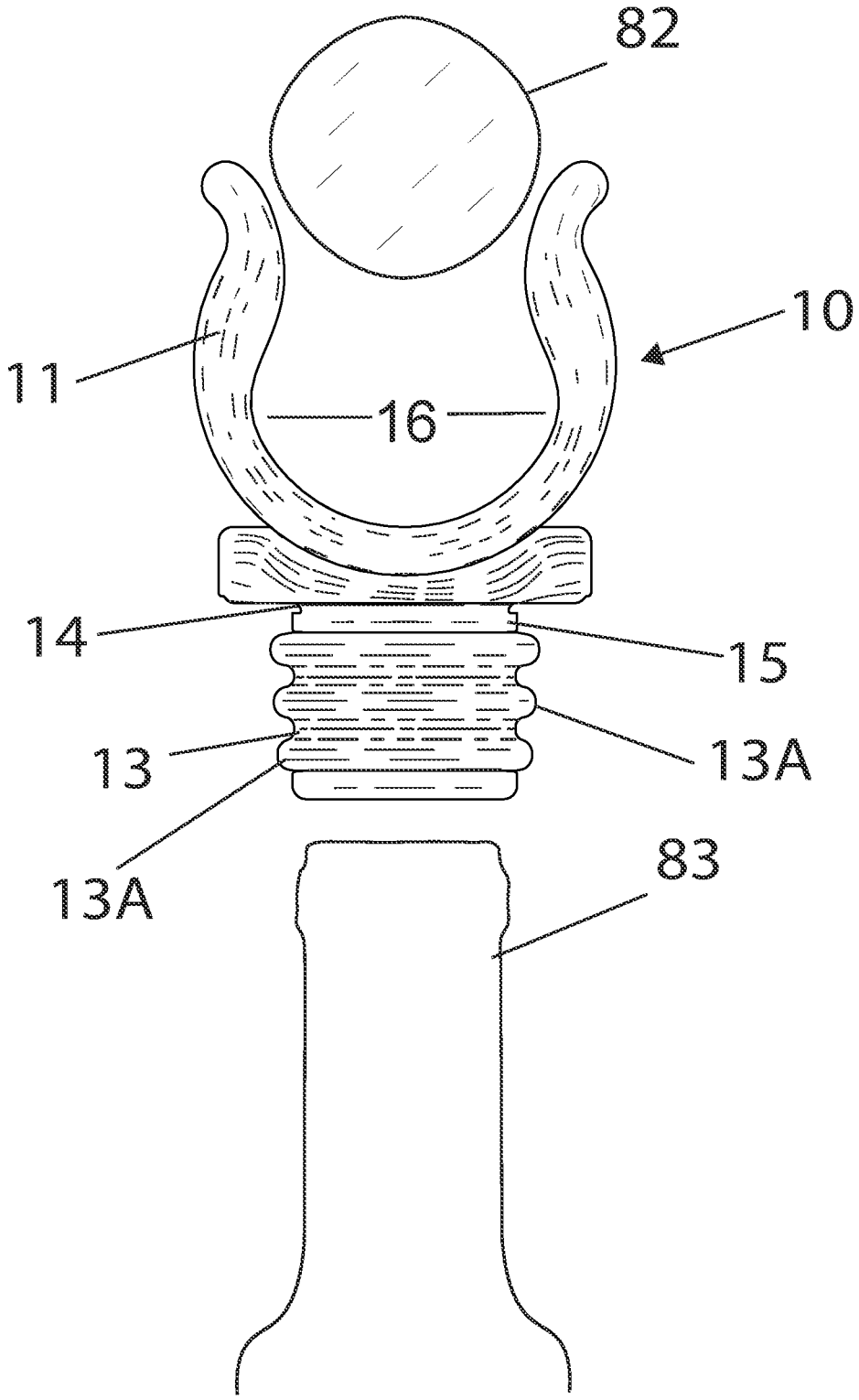

The arms 11A-D may have a curved geometry that is operable to position a cork between the arms to rest on top of the base 12. The curved geometry of the arms 11A-D may be convex at a lower portion thereof and convex at an upper section thereof. This shape allows a cork to be positioned on the upper portion of the arms 11A-11D without strong securement (e.g., just placed) and to be pushed from this position downward through the narrowest space between the arms 11A-11D into position in the cork slot 16 such that the cork rests on the base 12 and is pressure-fit and secured between the lower portions of the arms 11A-11D. The arms may be described as being in pairs, with a single pair of arms 11A-B forming a substantially U-shaped space as shown in FIGS. 4 and 5 for receiving the cork. Another pair of arms 11C-D may also form a U-shape space for receiving the cork.

The base 12 may include at least two aerating holes 14 that allow the fluid inside a bottle to be aerated. The aerating holes 14 may be in fluid communication with a passage 14A that exposes the interior of the bottle through the plug 15. The passage 14A is formed through the plug and may be a centrally (axially) positioned passage. In some embodiments, the passage may be multiple passages, where each of the aerating holes 14 has its own passage 14A passing through the plug 15 and providing fluid access to the interior of the bottle 83. In some embodiments, the shape of the aerating holes 14 may be elliptical. In other embodiments, the aerating holes 14 may be conical or slotted. The aerating holes 14 may be positioned orthogonally on opposite sides of the base 12, which may aid in airflow through the bottle, while providing an inlet and outlet for directional flow.

The cork holder 10 includes a plug 15 for insertion and engagement with the neck of a bottle. In the embodiment shown in FIGS. 1-12, the cork holder 10 includes a sleeve 13 on which protrusions 13A are positioned on the perimeter of the sleeve 13. In some embodiments, the plug 15 may have a cylindrical construction having a diameter that is less than the inner diameter of the neck of a wine bottle to allow the sleeve 13 to be stretched over the plug 15. In such embodiments, the sleeve 13 may be pressure fit, adhered, or otherwise secured to the plug 15, where the diameter of the plug 15 when the sleeve 13 is positioned on the plug 15 has an outer diameter that may be equal to or slightly larger than the inner diameter of the neck of the wine bottle 83 to allow compression of the protrusions 13A of the sleeve 13 and sealing of the wine bottle 83. The sleeve 13 may be fabricated from flexible and resilient polymeric material, such as silicone, polyvinyl chloride, polyethylene (e.g., low-density, medium density), or other appropriate materials. The sleeve 13 may include various numbers of protrusions (e.g., 1, 2, 3, 4, or more, in various configurations. The protrusions 13A may be barbs having a conical, pyramidal, fluke or other shape. The protrusions 13A may be ring like structures (e.g., like ribbing or circular barbs). In other embodiments, the protrusions 13A may be o-rings that are embedded in complementary channels formed in the perimeter of the plug 15.

The plug 15 may be a more rigid material such as a high-density PVC or other polymer, polished brass, polished steel, aluminum, wood, or other appropriate materials. In some embodiments, the plug 15 may be formed integrally with the base 12 of the cork holder 10. In some embodiments, the protrusions 13A of the plug 15 may be integrally formed in the plug, and may be formed monolithically of the same material. In such embodiments, the plug 15 may be fabricated from a flexible and resilient polymeric material, such as silicone, polyvinyl chloride, polyethylene (e.g., low-density, medium density), or other appropriate materials.

Cork 82 may be made from synthetic or organic materials such as oak trees or polyethylene. In other embodiments, corks 82 may be made from elastic materials, wood fibers, metals, plastic, or any other material that is suitable for a bottle stopper. In some embodiments, cork 82 may also prolong the life of the beverage contained inside bottle 83 and may increase the beverage's aroma and flavor.

Figure 10:
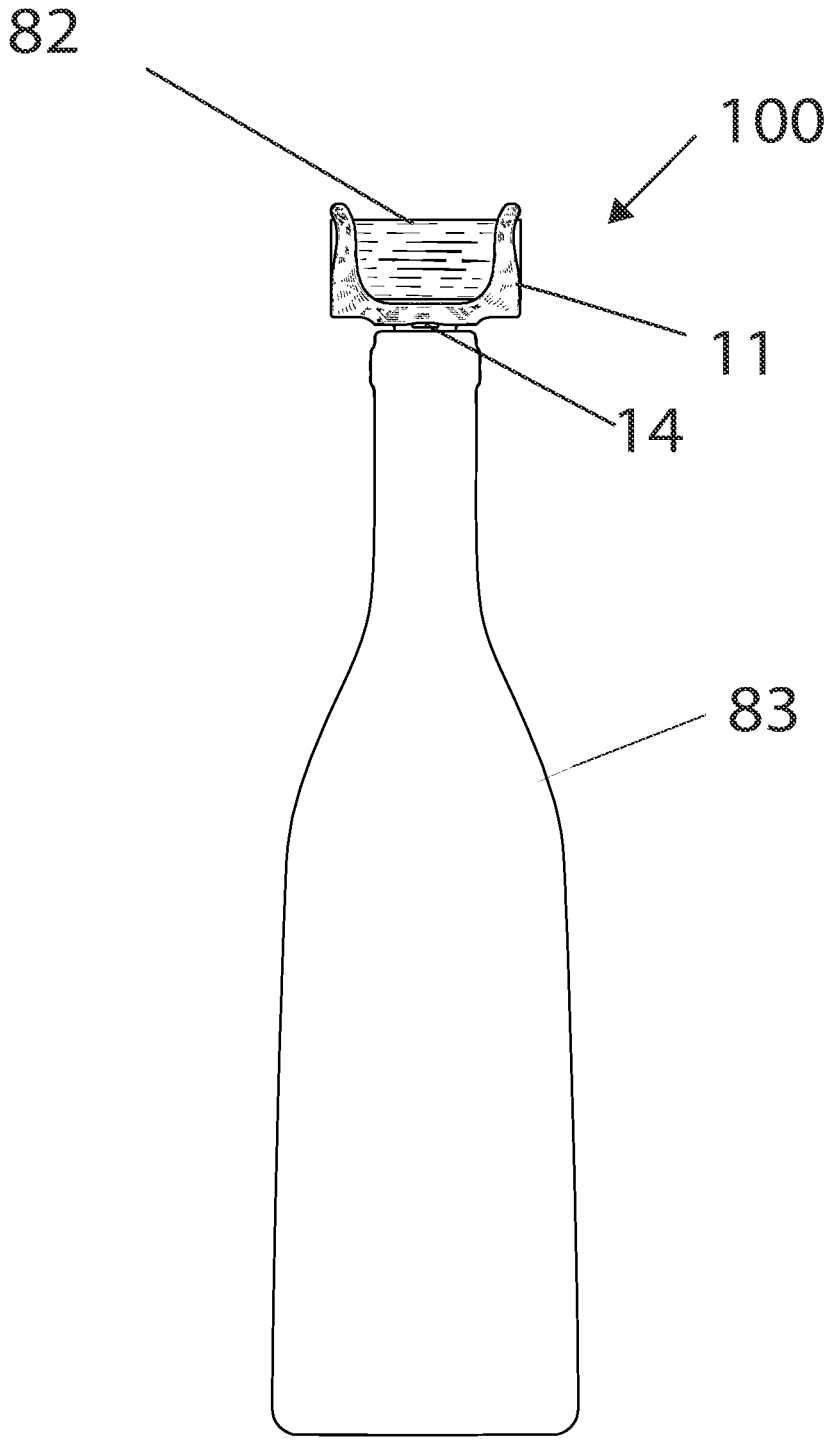
FIG. 10 provides an environmental view of a cork holder system, according to an embodiment of the present invention.
Figure 11:
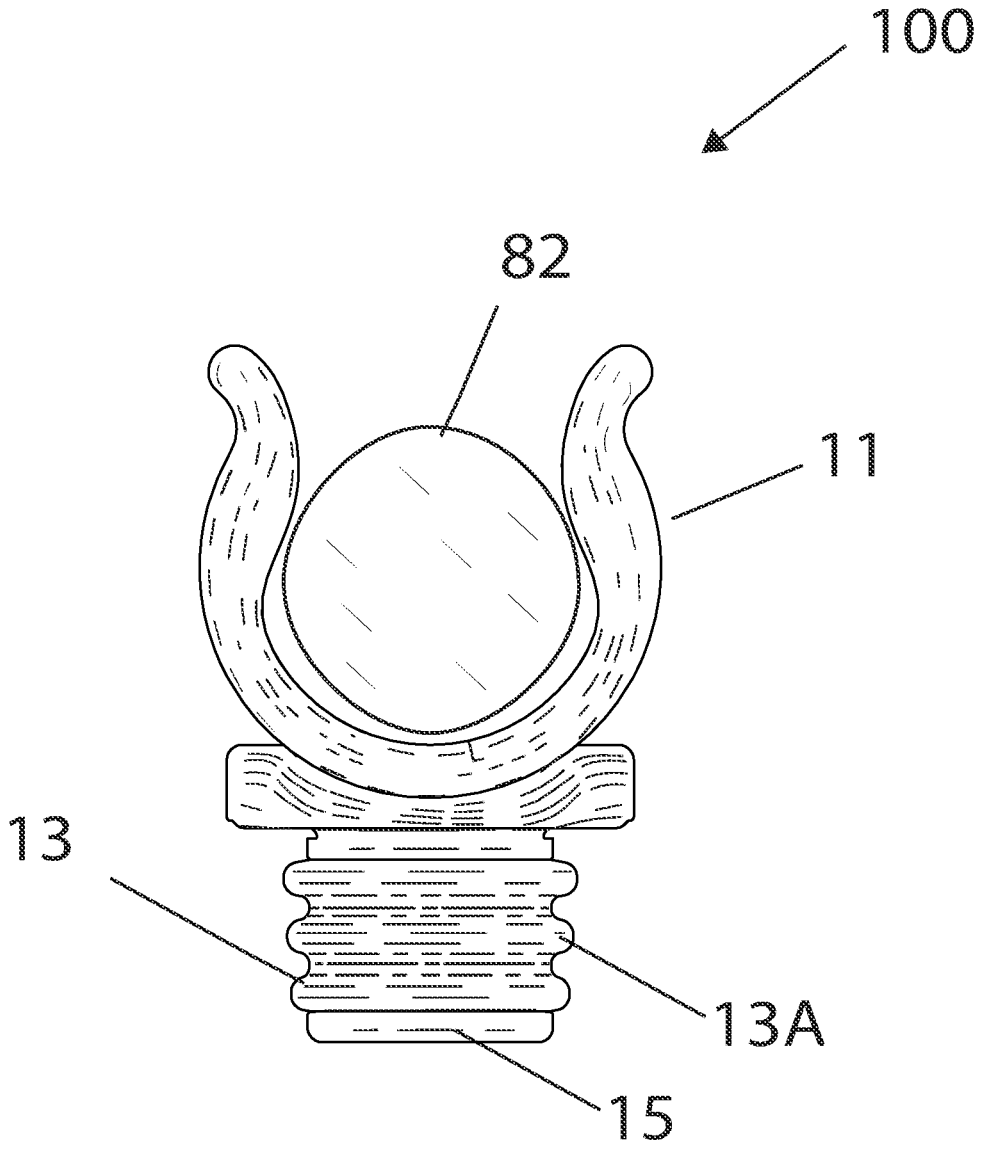
FIG. 11 provides a front view of another cork holder system according to an embodiment of the present invention.
Figure 12:
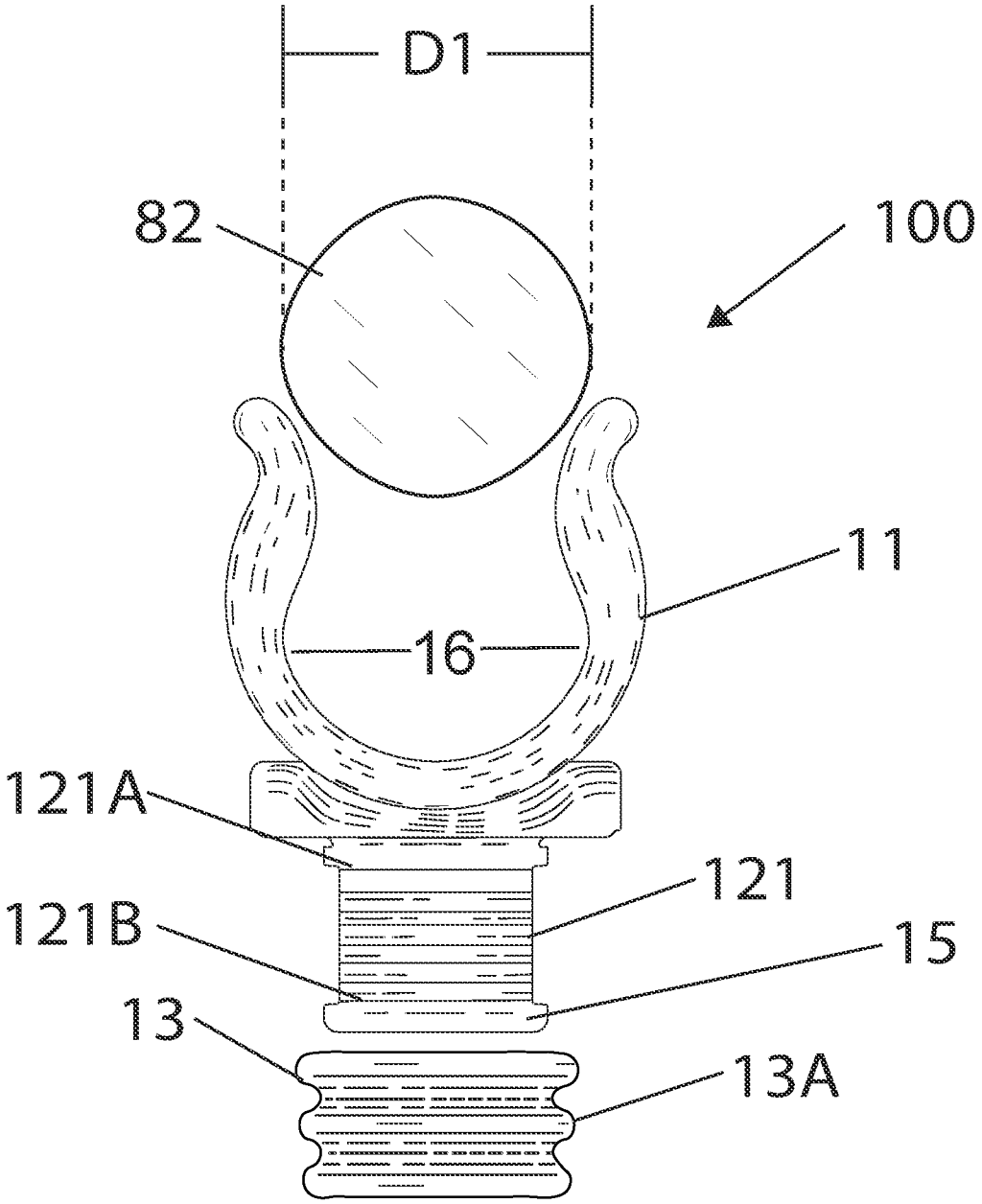
FIG. 12 provides a second exploded view of a cork holder system according to an embodiment of the present invention.

FIG. 12 shows an exploded view of a cork holder system 100 of FIG. 10. In some embodiments, sleeve 13 can be slid onto the plug 15 using a groove 121. The cork holder system 100 may also be attached to bottle 83 after attaching the sleeve 13 to groove 121. In such embodiments, the groove 121 may have an upper collar 121A and a lower collar 121B that are operable to position the sleeve 13 in a centered position. In some embodiments, a plurality of channels may be positioned between the upper collar 121A and lower collar 121B and may be operable to receive a sleeve 13 for providing a concentric watertight seal. The sleeve 13 may be removable and replaceable for cleaning and disinfecting the surfaces.

It is to be understood that the bottle 83 may include various contents other than wine, such as liquors, liqueurs, beer, and other types of beverages. In some embodiments, the bottle 83 may be a conventional wine bottle that may hold at least 187 mL of liquid. Examples of conventional wine bottles may include a Piccolo, a standard bottle, and a magnum bottle.

It is to be understood that variations, modifications, and permutations of embodiments of the present invention, and uses thereof, may be made without departing from the scope of the invention. It is also to be understood that the present invention is not limited by the specific embodiments, descriptions, or illustrations or combinations of either components or steps disclosed herein. The embodiments were chosen and described in order to best explain the principles of the invention and its practical application, to thereby enable others skilled in the art to best utilize the invention and various embodiments with various modifications as are suited to the particular use contemplated. Although reference has been made to the accompanying figures, it is to be appreciated that these figures are exemplary and are not meant to limit the scope of the invention. It is intended that the scope of the invention be defined by the claims appended hereto and their equivalents.

What is claimed is:

1. A wine aerating device operable to secure to a wine cork, the device comprising:

a. a plug operable to be pressure-fitted into a neck of a wine bottle;

b. a cork holder extending above said plug having a base and a plurality of independent arms that are operable to secure a cork on the base, wherein said plurality of independent arms create a slot with a diameter that is complementary to the geometry of a wine cork;

c. a sleeve positioned around the plug that is operable to provide a fluid-tight seal between a neck of the wine bottle and said plug; and d. at least one aeration hole operable to allow airflow.

2. The device of claim 1, wherein said at least one aeration hole includes a plurality of holes positioned around a perimeter of said base.

3. The device of claim 1, wherein said sleeve includes a plurality of protrusions for engagement with the interior of the neck of the wine bottle and is operable to provide a fluid-tight seal.

4. The device of claim 1, wherein said plurality of independent arms is four arms operable to secure said wine cork to the base, each of the four independent arms being positioned at or near a perimeter of the base in a substantially rectangular arrangement, each independent arm having a curved geometry and an unconnected distal end.

5. The device of claim 2, wherein said plurality of holes is at least two holes having a slotted geometry and are in fluid communication with a conduit passing through said plug.

6. The device of claim 5, wherein said conduit is positioned to aerate the contents of said bottle.

7. The device of claim 5, wherein said at least two aeration holes have a geometry operable to prevent contaminants from entering the bottle.

8. The device of claim 3, wherein said sleeve is received by said bottle to provide a watertight seal to said bottle.

9. The device of claim 1, wherein said base has a substantially rectangular geometry with a perimeter complementary to a lengthwise cross-section of the cork.

10. The device of claim 1, wherein said arms comprise a flexible material.

11. A wine aerating device operable to secure to a wine cork, the device comprising:

a. a plug having at least two aeration holes operable to allow the contents of the bottle to be aerated;

b. a cork holder extending above said bottle stopper wherein said cork holder includes a base and a plurality of independent arms that are operable to secure and display a cork; and c. a sleeve secured around the plug that is operable to provide a fluid-tight seal with the neck of a bottle and said bottle stopper.

12. The device of claim 11, wherein said at least two aeration holes are in fluid communication with a conduit passing through said bottle stopper.

13. The device of claim 11, wherein said plurality of independent arms is four arms operable to secure said wine cork to the base, each of the four independent arms being positioned at or near a perimeter of the base in a substantially rectangular arrangement, each independent arm having a curved geometry and an unconnected distal end.

14. A method for aerating wine and securing a wine cork, the method comprising:

a. inserting a wine bottle stopper into a neck of a wine bottle, the wine bottle stopper having:

i. a plug for engagement with the neck of the wine bottle and at least one protrusion located at a side of a plug, ii. a conduit passing through the plug that is in communication with at least one aeration port, and iii. a plurality of extensions that form a slot having a shape that is complementary to a cork, wherein said plurality of extensions are independent arms operable to secure said cork to the plug, each of the independent arms being positioned at or near a perimeter of the plug in a substantially rectangular arrangement, each independent arm having a curved geometry and an unconnected distal end; and b. securing the wine cork in said slot.

15. The method of claim 14, wherein said at least one port may include at least two ports that are operable to allow ambient air to pass into the wine bottle.

16. The method of claim 15, wherein said aeration ports are positioned orthogonal to a centerline of the plug.

17. The method of claim 14, wherein said plug is operable to form a fluid-tight seal between the plug and the neck of the bottle.

* * * * *